United States Patent [19]

Burkstaller et al.

[11] Patent Number: 5,006,013

[45] **Date of Patent: * Apr. 9, 1991**

[54] GRANULAR TYPE STRUCTURE WITH MOISTURE RETAINING TOP SURFACE

[75] Inventors: Herman F. Burkstaller; Emmet F. Brieger, both of Nogal, N. Mex.

[73] Assignee: Burco, Inc., El Paso, Tex.

[ * ] Notice: The portion of the term of this patent subsequent to Nov. 21, 2006 has been disclaimed.

[21] Appl. No.: 399,614

[22] Filed: Aug. 28, 1989

Related U.S. Application Data

[63] Continuation-in-part of Ser. No. 174,118, Mar. 28, 1988, Pat. No. 4,881,846.

[51] Int. Cl.[5] ..... A01G 25/00; E02B 11/00

[52] U.S. Cl. ..... 405/38; 405/50; 405/265

[58] Field of Search ..... 405/36–39, 405/43, 45, 50, 51, 265, 270; 47/48.5, 58; 404/27, 31

[56] References Cited

U.S. PATENT DOCUMENTS

| | | | |
|---|---|---|---|
| 585,856 | 7/1897 | Swanson . | |
| 1,222,648 | 4/1917 | Marks . | |
| 1,690,020 | 10/1928 | Kirschbraun . | |
| 1,862,423 | 6/1932 | Otto . | |
| 1,958,850 | 5/1934 | Foster | 94/7 |
| 2,024,158 | 12/1935 | Gallagher | 94/7 |
| 2,031,146 | 2/1936 | Dodge | 47/38 |
| 2,632,979 | 3/1953 | Alexander | 405/50 X |
| 2,837,984 | 6/1958 | Klotz | 404/27 X |
| 3,307,360 | 3/1967 | Bailly | 405/38 |
| 3,625,010 | 12/1971 | Hakundy | 405/38 |
| 3,687,021 | 8/1972 | Hensley | 404/31 |
| 3,870,422 | 3/1975 | Medico | 404/31 |
| 3,908,385 | 9/1975 | Daniel et al. | 405/37 |
| 4,015,432 | 4/1977 | Ball | 405/229 |
| 4,044,179 | 8/1977 | Haas, Jr. | 428/17 |
| 4,462,184 | 7/1984 | Cunningham | 405/37 X |
| 4,576,511 | 3/1986 | Vidal, Jr. | 405/37 |
| 4,832,526 | 5/1989 | Funkhouser | 405/43 |
| 4,881,846 | 11/1989 | Burkstaller et al. | 405/37 |

FOREIGN PATENT DOCUMENTS

| | | | |
|---|---|---|---|
| 2727956 | 6/1977 | Fed. Rep. of Germany | 405/38 |
| 482615 | 11/1951 | Italy | 405/38 |
| 111978 | of 1963 | Switzerland | 405/38 |

*Primary Examiner*—David H. Corbin

*Attorney, Agent, or Firm*—Deborah A. Peacock; Donovan F. Duggan; Robert W. Weig

[57] ABSTRACT

The disclosure is directed to a built-up granular structure having a stable moisture content controlled upper layer. The preferred granular structure includes an improved fine aggregate upper surface layer, a coarse aggregate reservoir layer having a topmost application of perforate adhesive material, and a dry moisture barrier layer having a topmost impervious layer. The entire layered structure is supported by any firm base including compacted soil or an existing playing court structure. A containment wall having screened drainage inlets/outlets surrounds the periphery of the structure.

38 Claims, 1 Drawing Sheet

GRANULAR TYPE STRUCTURE WITH MOISTURE RETAINING TOP SURFACE

CROSS-REFERENCE TO RELATED APPLICATIONS

This application is a continuation-in-part application of U.S. Pat. No. 4,881,846, entitled BUILT-UP PLAYING COURT SURFACE STRUCTURE AND METHOD FOR ITS CONSTRUCTION, to Burkstaller, et al., filed on Mar. 28, 1988, the teachings of which are incorporated herein by reference. This application is also related to an application filed concurrently and on even date herewith, entitled IMPROVED MOISTURE RETAINING TOP SURFACE FOR A BUILT-UP GRANULAR STRUCTURE AND METHOD FOR ITS CONSTRUCTION, to Burkstaller, et al., the teachings of which are incorporated herein by reference.

BACKGROUND OF THE INVENTION

1. Field of the Invention

The present invention relates to a built-up playing court structure, enabling a selected moisture content to be maintained within its surface layer, and a method for its construction.

2. Description of the Related Art Includinq Information Disclosed Under 37 C.F.R. 1.97-1.99

There are at present two basic types of surfaces used for playing courts, "hard" surfaces and "soft" surfaces. Hard surface courts generally have concrete and asphalt surfaces and, indoors, wood surfaces. Soft surface courts generally have lawn, clay and various composite built up surfaces. To effectively play court games, one is required to repeatedly turn and move with rapidity. One of the primary disadvantages of the use of hard surface courts is that the bones, muscles and connective tissues of players are stressed by repetitive activity on the hard surface. Conventional soft surface courts however, also have disadvantages. Construction and maintenance costs are typically very high. Frequent cutting, rolling, smoothing and replenishing of the surface materials is required to keep the surface in a playable condition. Additionally, since most of these soft surface courts are constructed outdoors, and are porous, water retention following ambient rainfall may preclude play on the court surface due to puddles or a general muddy court surface having a slippery consistency.

Built-up playing courts consisting of gravel, sand, clay and various bonding materials have been developed in the art as a more practical alternative to conventional clay courts. A clay or sand top surface layer is desirable, because such a layer makes a surface more playable by providing smoothness yet appropriate traction for the soles of players, shoes. However, there are several problems inherent in such conventional built-up surfaces. Loose sand or clay which is normally present at the uppermost surface layer over time, washes down through the lower layer materials, such as gravel, due to rain or sprinkling; this sand or clay is thus lost from the surface and has to be periodically replaced. Drainage of such courts presents a problem because the sand or clay tends to fill all of the void spaces between the lower surface materials (e.g. gravel). Thus, water will not drain laterally below the surface at a sufficiently fast rate. Hence, water drainage usually runs off over the top surface, gradually removing the surface materials. Even if the surface materials are not washed away, they tend to be redistributed unevenly, causing smoothing problems. Furthermore, unless the surface is adequately sloped and almost perfectly uniform, there will be standing puddles of water following rains which will preclude use of the court until the water is removed by evaporation. Almost all conventional soft surface and hard surface courts have a slope in an attempt to prevent puddling. Another problem occurs in cold weather areas. Water trapped within the void spaces below the surface freezes. The expansion that takes place during freezing causes movement of the surface, thereby damaging it. Repair is necessary to smooth the damaged areas. Another problem is that wind tends to blow away or unevenly rearrange surface materials, especially when the surface is dry; again, requiring replacement or smoothing. This problem could be alleviated considerably by sprinkling the surface with water. However, during periods of winds or play, sprinkling is impractical. Another problem with wind is that the top surface tends to dry out, resulting in poor footing for the players and inconsistent ball bounce.

Since court games, particularly tennis, are played by millions of people, much time and energy has been devoted to solving such problems inherent in maintaining outdoor athletic courts or similar structures. Examples of proposed solutions to some of the problems are disclosed in U.S. Pat. Nos. 585,856, entitled Underground Irrigation, to Swanson; U.S. Pat. No. 3,307,360, entitled Method of Subsurface Irrigation and System Therefor, to Bailly; U.S. Pat. No. 3,625,010, entitled System and Method for Preventing Erosion, to Hakundy; U.S. Pat. No. 1,222,648, entitled Growing Trough, to Marks; U.S. Pat. No. 2,031,146, entitled Automatic Watering Device, to Dodge; Czechoslovakian Patent No. 111978 to Sramek; Italian Patent No. 482615 to Ortensi; German Patent No. 27 27 956, to Blank; U.S. Pat. No. 1,862,423, entitled Playing Court, to Otto; U.S. Pat. No. 1,958,850, entitled Tennis Court, to Foster; U.S. Pat. No. 4,015,432, entitled Stabilizing Subsoil Moisture Under Light Structures, to Ball; U.S. Pat. No. 1,690,020, entitled Pavement and Process of Laying Same, to Kirschbraun; U.S. Pat. No. 2,024,158, entitled Playing Court, to Gallagher; U.S. Pat. No. 4,044,179, entitled Playing Surface for Athletic Games, to Haas, Jr.; U.S. Pat. No. 3,908,385, entitled Planted Surface Conditioning System, to Daniel, et al.; and U.S. Pat. No. 4,576,511, entitled Apparatus and Method of Creating and Controlling an Artificial Water Table, to Vidal, Jr. None of these patents teach the unique court surface structure of the present invention having a built-up court surface layer, a stabilizing subsurface layer, and means for selectively controlling moisture content in the built-up court surface layer. These patents are discussed in more detail below.

The '856, '360, '010, '648, '146, patents and Czechoslovakian Patent No. 111978, disclose subsurface irrigation devices. The irrigation systems are used for providing water to a vegetative or natural soil surface cover. Italian Patent No. 482615 and German Patent No. 27 27 956 disclose a subsurface irrigation system for sports fields with granular surface covers. The '432 patent discloses a subsurface moisture barrier.

The '020, '158 and '179 patents disclose permanent, fixed surfaces. The '020 patent is directed to a combined bituminous and concrete pavement surface. The '158 patent teaches a playing court surface atop cork/sand gravel beds. The '179 patent discloses an artificial turf fabric surface which is intended to simulate grass.

The '385 patent discloses a system for irrigating and evacuating a playing field having a vegetative cover. This system incorporates a lattice of perforated pipes under the playing surface. The pipes are covered by a layer of sand followed by a layer of rooting media on which the vegetative matter is grown. A pump attached to the pipe lattice allows a vacuum to be applied and accumulated surface water to be drawn down within the subsurface sand layer. Also incorporated into the system is a moisture sensor which allows automatic irrigation of the field.

The '423 patent discloses a soft surface court having a pervious surface layer which enhances drainage and moisture retention, depending upon ambient conditions. The '850 patent teaches the use of fine epidote as a top layer and coarser epidote as a lower layer for a tennis court surface. Neither of these patents provide means for moisturizing the surface.

The '511 patent discloses means and apparatus for maintaining a selected water level in a layered structure of particulate material.

RELATED APPLICATIONS

Prior application, U.S. Pat. No. 4,881,846, entitled BUILT-UP PLAYING COURT STRUCTURE AND METHOD FOR ITS CONSTRUCTION, to Burkstaller, et al., filed Mar. 28, 1988, the teachings of which are incorporated herein by reference, relates to a built-up, moisture content controlling playing court structure comprising a built-up court surface layer; a barrier surface substantially impervious to moisture spaced beneath the built-up court surface layer; a containment wall positioned essentially peripherally about the built-up court surface layer and the barrier surface and extending upwardly from the barrier surface to about the level of the built-up court surface layer disposed thereabove; a subsurface bed of aggregate disposed atop the barrier surface and beneath the built-up court surface layer, the aggregate bed being peripherally surrounded by the containment wall; and means, preferably piping, for controllably introducing liquid to and draining liquid from the subsurface bed of aggregate and the built-up court surface layer to substantially maintain a selected moisture content in the built-up court surface layer. Moisture content in the surface layer of parent application, U.S. Pat. No. 4,881,846, is controlled by maintaining an appropriate liquid level in the subsurface bed, thereby providing upward movement of moisture by capillary action or wicking to the top surface layer. The moisturizing rate, which can be controlled to be essentially equal to the evaporation rate, is determined by the liquid level and the particle sizes in the subsurface bed.

Co-pending application filed concurrently herewith, entitled IMPROVED MOISTURE RETAINING TOP SURFACE FOR A BUILT-UP GRANULAR STRUCTURE AND METHOD FOR ITS CONSTRUCTION, to Burkstaller, et al., the teachings of which are incorporated herein by reference, discloses a surface for built-up granular structures. This surface is useful in the present application.

SUMMARY OF THE INVENTION

The invention relates to a built-up, moisture content controlling granular structure and method of construction. The preferred structure comprises an upper surface layer comprising fine aggregate material; a barrier surface substantially impervious to moisture spaced beneath the upper surface layer; a containment means positioned essentially peripherally around the structure; a subsurface reservoir bed disposed atop the barrier surface and beneath the upper surface layer, the subsurface reservoir bed being peripherally surrounded by the containment wall; and means for stabilizing the subsurface reservoir bed and for providing adequate fluid conductivity between the subsurface reservoir bed and the upper surface layer to substantially maintain the selected moisture content in the upper surface layer.

The upper surface layer comprises fine aggregate, such as igneous, metamorphic, sedimentary, and synthetic materials. The preferred fine aggregate is primarily volcanic material or a mixture of granite, marble, quartzite, and limestone, although basalt, felsite, rhyolite, augite, olivine, biotite, silica, obsidian, tuff, volcanic ash and dust, agglomerates, latite, monzanite, dacite, granodiorite, andresite, dorite, dolomite, marble, mica, feldspar, quartz, calcite, gabbro, syenite, diorite, gneiss, schist, or mixtures thereof are also useful in accordance with the invention.

The stabilizing and fluid conductivity providing means preferably comprises a stabilizing layer of adhesive material disposed atop the subsurface reservoir bed. This layer of adhesive material comprises voids therein to provide adequate fluid conductivity between the subsurface reservoir bed and the upper surface layer thereabove to substantially maintain the selected moisture content in the upper surface layer. The upper surface layer of fine aggregate material is preferably disposed atop and in the voids of the adhesive coated stabilizing layer.

The structure may comprise a support bed of aggregate disposed beneath the barrier surface. The barrier surface comprises an intermediate stabilizing layer disposed atop the support bed of aggregate. This intermediate stabilizing layer may comprise an adhesive material, preferably with voids therein to provide supportive stability to the support bed of aggregate and adequate fluid conductivity between the subsurface bed of aggregate and the support bed of aggregate to maintain selected moisture content in the structure. Alternatively, the adhesive material may be a solid layer substantially free of voids or the barrier surface may comprise a solid layer, such as a plastic sheet.

The structure may further comprise means for controllably introducing fluid to and draining fluid from the subsurface bed of aggregate and the upper surface layer to substantially maintain a selected moisture content in the upper surface layer. This fluid controlling means preferably comprises surface watering means, such as sprinklers, conduit disposed between the upper surface layer and the subsurface bed of aggregate, or surface flooding means. The surface flooding means may also serve as drainage means. The subsurface reservoir bed in the structure preferably comprises coarse aggregate, a mortar material, preferably comprising a mixture of cement, sand and water, wherein the proportion by volume of cement to sand is approximately one part cement to 10–20 parts sand, or a mixture thereof.

The present invention further provides a method of constructing a built-up, moisture content controlling granular structure comprising the following steps obtaining a foundation for the granular structure; providing a moisture barrier above the foundation; providing a containment wall peripherally about the foundation;

providing a subsurface reservoir bed above the moisture barrier; providing an upper surface layer comprising fine aggregate atop the subsurface reservoir bed; and providing means for stabilizing the subsurface reservoir bed and for providing adequate fluid conductivity between the subsurface reservoir bed and the upper surface layer to substantially maintain the selected moisture content in the upper surface layer.

The method may further comprise the steps of providing a support bed of aggregate beneath the barrier and controllably introducing fluid to and draining fluid from the subsurface bed of aggregate and the upper surface layer to substantially maintain a selected moisture content in the upper surface layer.

A primary object of the present invention is to regulate the moisture content in the surface of a granular-type built-up structure.

Another object of the invention is to provide a surface of consistent quality.

A further object of the present invention is to provide a built-up granular surface which is inexpensive to construct and maintain.

One advantage of this invention is that in accordance therewith, surface runoff during rain can be greatly reduced to essentially eliminate washing away and puddling of the surface.

Another advantage of the invention is that wind erosion is substantially reduced by providing moisture to the granular surface at all times, including windy periods.

Yet another advantage of the invention is the elimination of costly and complicated moisturizing and drainage apparatus.

Other objects, advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWING

The accompanying drawings, which are incorporated into and form a part of the specification, illustrate several embodiments of the present invention and, together with the description, serve to explain the principles of the invention.

DETAILED DESCRIPTION OF THE PREFERRED EMBODIMENTS OF THE INVENTION

The present invention relates to a built-up granular structure having a system for controlling the moisture content of the playing surface and the court structure. The invention can be utilized in the construction of new structures or to convert or retrofit existing structures, such as playing courts.

Figure 1:
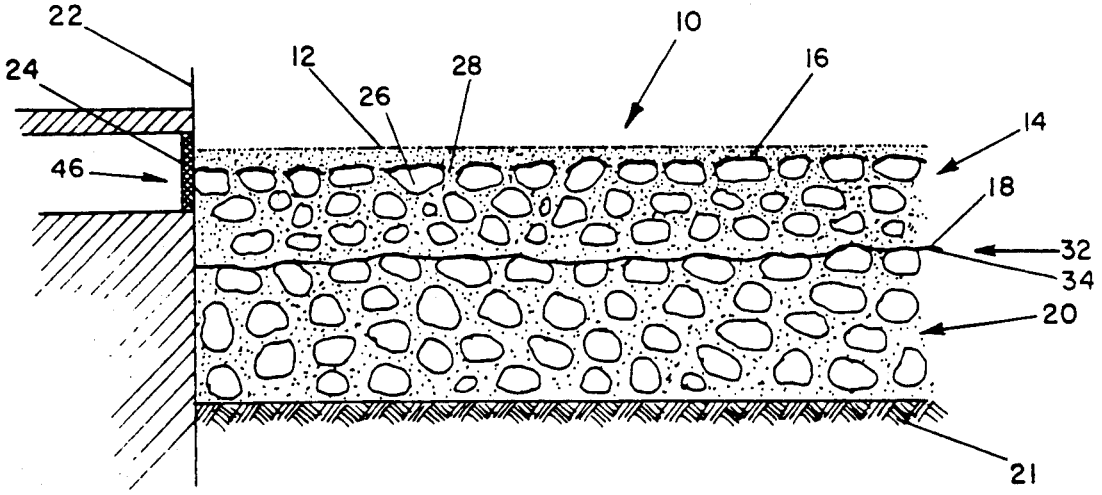
FIG. 1 is a cross-sectional view of a section of the built-up granular structure of the invention.

FIG. 1 shows a preferred built-up granular structure 10 in accordance with the present invention comprising an upper surface layer 12, a perforate adhesive layer 16 below the upper surface layer 12, a coarse aggregate reservoir layer 14, an intermediate imperforate adhesive 18, a support layer 20, and a base 21. A containment wall 22, with screened drainage outlets 46 therein, surrounds the periphery of court structure 10. The present invention incorporates the invention described in prior application, U.S. Pat. No. 4,881,846, entitled BUILT-UP PLAYING COURT STRUCTURE AND METHOD FOR ITS CONSTRUCTION, to Burkstaller, et al., filed Mar. 28, 1988, with the differences or improvements being the use of surface moisture control instead of subsurface moisture control, the use of an intermediate adhesive elastomer layer or moisture barrier layer, and the use of a mortar material in place of the adhesive elastomer layer. The present invention also includes the surface materials disclosed in detail in co-pending application filed concurrently herewith, entitled IMPROVED MOISTURE RETAINING TOP SURFACE FOR A BUILT-UP GRANULAR STRUCTURE AND METHOD FOR ITS CONSTRUCTION, to Burkstaller, et al.

Figure 2:
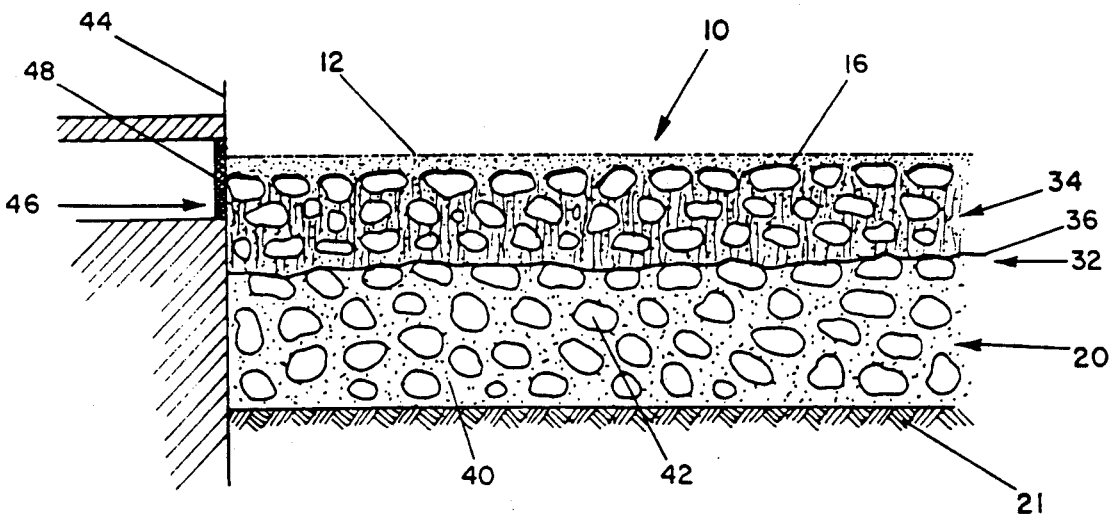
FIG. 2 is a cross-sectional view of an alternative built-up granular structure of the invention.

Referring now to FIGS. 1 and 2, the preferred upper layer 12 of the improved structure 10 is disclosed in co-pending application filed concurrently herewith, entitled IMPROVED MOISTURE RETAINING TOP SURFACE FOR A BUILT-UP GRANULAR STRUCTURE AND METHOD FOR ITS CONSTRUCTION, to Burkstaller, et al., although other surfaces may be employed, such as disclosed in prior application, U.S. Pat. No. 4,881,846, entitled BUILT-UP PLAYING COURT STRUCTURE AND METHOD FOR ITS CONSTRUCTION, to Burkstaller, et al., filed March 28, 1988. That upper layer 12 provides a simple yet effective surface of fine aggregate. Both drainage and moisturization of this improved upper surface layer are accomplished by controllably introducing fluid directly at this surface either manually, by automatic sprinklers, or by any other direct surface watering means; that is, no expensive and complicated subterranean piping or drainage system is required. The upper layer may be level so drainage takes place at the periphery of the upper surface layer. The relative size proportions of fine aggregate in the upper surface layer provide a bonding effect when moisturized, resulting in a court surface having increased "playability." Nevertheless, the high retained moisture content of the surface also provides a safety margin in that safe footing is provided, decreasing the possibility of knee and ankle injuries. Any desired thickness may be used to accomplish the desired moisture content of upper layer 12, although it is preferably between approximately ¼ inch and ½ inch thick. Reference is made to co-pending application filed concurrently herewith, for a complete description of the preferred upper surface layer.

In the preferred embodiment, shown in FIG. 1, a perforate adhesive elastomer layer 16 is disposed immediately below surface layer 12, and above reservoir layer 14. This substantially impervious adhesive layer locks substantially closely spaced and touching coarse aggregate particles 26 disposed in the reservoir layer 14 together, while permitting free percolation of moisturizing liquid or fluids therethrough. This adhesive coating or layer 16 preferably comprises polyurethane, epoxy, rubberized asphalt, or a mixture thereof. This adhesive layer is discussed in detail in prior application, U.S. Pat. No. 4,881,846, entitled BUILT-UP PLAYING COURT STRUCTURE AND METHOD FOR ITS CONSTRUCTION, filed Mar. 28, 1988, and co-pending application filed concurrently herewith, entitled IMPROVED MOISTURE RETAINING TOP SURFACE FOR A BUILT-UP GRANULAR STRUCTURE AND METHOD FOR ITS CONSTRUCTION.

The reservoir layer 14 itself, in the preferred embodiment shown in FIG. 1, comprises a mixture of coarse aggregate 26 and fine aggregate 28, such as sand and gravel. This layer provides a reservoir function; water percolates upwards and downwards between the upper layer 12 and this reservoir layer 14. Depending upon the desired moisture content of the upper layer 12, the fine aggregate 28 of the reservoir layer 14 allows for saturation of the reservoir layer 14. The uppermost coarse aggregate 26 particles in the reservoir layer 14 are secured together by the coating of adhesive elastomer 16, creating an adhesive foraminous elastomeric layer or a web-like layer. The interstices or voids 30 between the coarse aggregate particles 26 in the reservoir layer 14 are filled with fine aggregate 28; the fine aggregate 28 is not coated with the adhesive elastomer 16, thus allowing the free percolation of water between the upper layer 12 and the reservoir layer 14. The voids 30 in the reservoir layer 14 containing the fine aggregate 28 are saturated with fluid, thus not only storing fluid, but providing supportive stability to the coarse aggregate 26 in this layer 14. The fluid moves upwardly by capillary or wicking action and downwardly by gravity. Obviously, the moisture content of the upper surface layer 12 can be controlled by maintaining a selected degree of liquid saturation in the reservoir layer 14. The reservoir layer 14 also provides support for the upper layer 12. This reservoir layer 14 is discussed in detail in prior application, U.S. Pat. No. 4,881,846, entitled BUILT-UP PLAYING COURT STRUCTURE AND METHOD FOR ITS CONSTRUCTION, filed Mar. 28, 1988, and in co-pending application filed concurrently herewith, entitled IMPROVED MOISTURE RETAINING TOP SURFACE FOR A BUILT-UP GRANULAR STRUCTURE AND METHOD FOR ITS CONSTRUCTION.

Several alternatives exist as to the exact composition of the reservoir layer 14. As noted previously, the coarse aggregate and fine aggregate mixture, discussed above, may be used. The reservoir layer 14 may be made of any thickness, depending on the need to more rapidly absorb excess water. The preferred thickness of the reservoir layer 14 is less than one inch.

In an alternative embodiment for the reservoir layer 14, shown in FIG. 2, the adhesive layer 18 and the sand-gravel aggregate, shown in FIG. 1, can be eliminated and replaced by a mortar mixture 34. This mortar mixture is preferably a weakly consolidated cement-sand-water mixture. The preferred mortar mixture comprises ten to twenty parts sand by volume to one part of Portland cement. All the heretofore described functions of the reservoir layer 14 would still accrue: reservoir layer stabilization, moisture retention, storage for a desired volume of moisturizing fluid for the upper layer, moisture transfer between the upper layer and reservoir, and support of the upper layer. One advantage to this mortar material is that no perforate adhesive layer is required.

As shown in FIGS. 1 and 2, underlying the reservoir layer 14 is an intermediate imperforate moisture barrier 32. This moisture barrier 32 in FIG. 1 is shown as a solid adhesive layer 18 and as an impermeable sheet 36, such as a plastic sheet, in FIG. 2. If an adhesive elastomer is utilized as the moisture barrier 32, the preferred materials are polyurethane, epoxy, rubberized asphalt, or a mixture thereof. Unlike the uppermost adhesive layer 16, shown in FIG. 1, however, this intermediate adhesive layer 34, also shown in FIG. 1, is applied to all of the aggregate, coarse aggregate and fine aggregate, in the next downward layer, the support layer 20. This intermediate layer 34 also stabilizes the underlying aggregate in the support layer 20 and is substantially impervious to moisture and free of voids. This moisture barrier 32 functions as a barrier to moisture between the base 21 and the reservoir layer 14. This moisture barrier 36 in the FIG. 2 configuration is optional and may be eliminated to simplify construction.

Like the reservoir layer 14, the support layer 20 also preferably comprises coarse aggregate 42 and fine aggregate 40, and also supports the overlying layers. Unlike the reservoir layer 14, however, the support layer 20 is dry throughout because of the moisture barrier 32. The dry fine aggregate 40 stabilizes the coarse aggregate 42. The preferred fine aggregate 40 may be sand, although other fine aggregate materials may be utilized in accordance with the invention, such as disclosed in prior application, U.S. Pat. No. 4,881,846, entitled BUILT-UP PLAYING COURT STRUCTURE AND METHOD FOR ITS CONSTRUCTION, filed Mar. 28, 1988, and co-pending application filed concurrently herewith, entitled IMPROVED MOISTURE RETAINING TOP SURFACE FOR A BUILT-UP GRANULAR STRUCTURE AND METHOD FOR ITS CONSTRUCTION. Likewise, the preferred coarse aggregate 42 is gravel or pebbles, but other coarse aggregate materials may be utilized in accordance with the invention, such as disclosed in those applications mentioned above. The coarse aggregate 42 is preferably three-quarter inch to one inch in diameter. This support layer 20 rests directly upon the base 21 which may be an existing structure, soil, or any other firm, preferably (but not necessarily) level surface. While desirably so, base 21 need not be level inasmuch as support layer 20 will compensate for any unevenness therein. No sealant or impermeable layer is required between this base 21 and the support layer 20, such as is disclosed in prior application Ser. No. 07/174,118, entitled BUILT-UP PLAYING COURT STRUCTURE AND METHOD FOR ITS CONSTRUCTION, filed Mar. 28, 1988, and co-pending application filed concurrently herewith, entitled IMPROVED MOISTURE RETAINING TOP SURFACE FOR A BUILT-UP GRANULAR STRUCTURE, AND METHOD FOR ITS CONSTRUCTION, since this function is performed by support layer 20 and moisture barrier 32.

In an alternative embodiment, not shown, a permeable layer could replace the moisture barrier 32 shown in FIGS. 1 and 2. In such an embodiment, an alternative moisture barrier would need to be disposed beneath the aggregate, such as atop the base 21, as disclosed in prior application, U.S. Pat. No. 4,881,846, entitled BUILT-UP PLAYING COURT STRUCTURE AND METHOD FOR ITS CONSTRUCTION, filed Mar. 28, 1988. This embodiment is useful when a thicker aggregate bed is needed for drainage. The preferred additional permeable layer is an adhesive elastomer layer, such as discussed above, to allow fluid conductivity between beds, yet stabilize the coarse aggregate.

The thickness of the layers or beds and the coarseness of the aggregate can be varied, depending on moisturization and stability factors. The invention is not limited to the particular beds represented in the drawings.

Containment walls 44 are disposed about the periphery of the layered structure, preferably four inches to six inches high, but they could be of any desired height. Also placed in the containment are drainage outlets 46 to directly remove fluid surplus at the upper layer 12. These drainage outlets 46 can also be used as inlets to introduce water to the structure by flooding the upper layer 12. As many outlets/inlets 46 as deemed necessary are provided; they may be screened 24 to prevent aggregate from entering. Such screens 24 should be of finer mesh than the finest aggregate of the upper layer 12.

Moisturization of the structure 10 can be accomplished by utilizing natural rain in combination with the reservoir layer 14. The reservoir layer 14 becomes saturated with the water for use in moisturizing the upper layer 12 by wicking action, over an extended period, such as a day or more. Excess water is drained through the outlets 46. In dry climates or periods, watering or moisturization can be achieved by sprinkling, either manual or automatic, of the upper layer 12, by flooding the upper layer 12 through the conduit outlets 46 (which also serve as inlets), by sunken hoses in the upper layer 12 (particularly useful in windy conditions), or other means, common to the art, for providing moisturization to surfaces. As discussed in prior application, U.S. Pat. No 4,881,846, entitled BUILT-UP PLAYING COURT STRUCTURE AND METHOD FOR ITS CONSTRUCTION, filed Mar. 28, 1988, other fluids, such as weed killer and antifreeze, can be utilized to not only moisturize the surface, but provide other functions.

The invention further comprises a method for constructing a built-up, moisture content controlling granular structure comprising the steps of obtaining a foundation for the granular structure; providing a moisture barrier above the foundation; providing a containment wall peripherally about the foundation; providing a subsurface reservoir bed above the moisture barrier; providing an upper surface layer comprising fine aggregate atop the subsurface reservoir bed; and providing means for stabilizing the subsurface reservoir bed and for providing adequate fluid conductivity between the subsurface reservoir bed and the upper surface layer to substantially maintain the selected moisture content in the upper surface layer. Maintenance of the upper layer 12 is accomplished by wide drag brooming or other means, common to the art, for maintaining granular surfaces.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. A built-up, moisture content controlling granular structure comprising:

an upper surface layer comprising fine aggregate material;

a barrier surface substantially impervious to moisture spaced beneath said upper surface layer;

a containment means positioned essentially peripherally around said structure;

a subsurface reservoir bed disposed atop said barrier surface and beneath said upper surface layer, said subsurface reservoir bed being peripherally surrounded by said containment means; and means for stabilizing said subsurface reservoir bed and for providing adequate fluid conductivity between said subsurface reservoir bed and said upper surface layer to substantially maintain the selected moisture content in said upper surface layer, said stabilizing and fluid conductivity providing means comprising a stabilizing layer of adhesive material disposed atop said subsurface reservoir bed, said layer of adhesive material comprising voids therein to provide adequate fluid conductivity between said subsurface reservoir bed and said upper surface layer thereabove to substantially maintain the selected moisture content in said upper surface layer, and said upper surface layer of fine aggregate material disposed atop and in said voids of said adhesive coated stabilizing layer.

2. The invention of claim 1 wherein said upper surface layer comprises fine aggregate comprising at least one member selected from the group consisting of igneous, metamorphic, sedimentary, and synthetic materials.

3. The invention of claim 2 wherein said fine aggregate comprises primarily volcanic material.

4. The invention of claim 2 wherein said fine aggregate comprises a mixture of granite, marble, quartzite, and limestone.

5. The invention of claim 2 wherein said fine aggregate comprises at least one member selected from the group consisting of basalt, felsite, rhyolite, augite, olivine, biotite, silica, obsidian, tuff, volcanic ash and dust, agglomerates, latite, monzanite, dacite, granodiorite, andresite, dorite, dolomite, marble, mica, feldspar, quartz, calcite, gabbro, syenite, diorite, gneiss, schist, or mixtures thereof.

6. The invention of claim 1 further comprising a support bed of aggregate disposed beneath said barrier surface.

7. The invention of claim 6 wherein said barrier surface comprises an intermediate stabilizing layer disposed atop said support bed of aggregate:

8. The invention of claim 7 wherein said intermediate stabilizing layer comprises an adhesive material.

9. The invention of claim 8 wherein said adhesive material of said intermediate stabilizing layer comprises voids therein to provide supportive stability to said support bed of aggregate and adequate fluid conductivity between said subsurface bed of aggregate and said support bed of aggregate to maintain selected moisture content of said structure.

10. The invention of claim 8 wherein said adhesive material of said intermediate stabilizing layer comprises a solid layer substantially free of voids.

11. The invention of claim 6 wherein said barrier surface comprises a plastic sheet.

12. The invention of claim 1 further comprising means for controllably introducing fluid to and draining fluid from said subsurface bed of aggregate and said upper surface layer to substantially maintain a selected moisture content in said upper surface layer.

13. The invention of claim 12 wherein said fluid controlling means comprises surface watering means.

14. The invention of claim 13 wherein said surface watering means comprises conduit means disposed between said upper surface layer and said subsurface bed of aggregate.

15. The invention of claim 13 wherein said surface watering means comprises surface flooding means.

16. The invention of claim 15 wherein said surface flooding means also serves as drainage means.

17. The invention of claim 1 wherein said subsurface reservoir bed comprises coarse aggregate.

18. The invention of claim 1 wherein said subsurface reservoir bed comprises a mortar material.

19. The invention of claim 18 wherein said mortar material comprises a mixture of cement, sand and water.

20. The invention of claim 19 wherein the proportion by volume of cement to sand is approximately one part cement to 10–20 parts sand.

21. The invention of claim 18 wherein said mortar material further comprises coarse aggregate.

22. A method of constructing a built-up, moisture content controlling granular structure comprising the following steps:

(a) obtaining a foundation for the granular structure;
(b) providing a moisture barrier above the foundation;
(c) providing a containment wall peripherally about the foundation;
(d) providing a subsurface reservoir bed above the moisture barrier;
(e) providing an upper surface layer comprising fine aggregate atop the subsurface reservoir bed; and
(f) providing means for stabilizing the subsurface reservoir bed and for providing adequate fluid conductivity between the subsurface reservoir bed and the upper surface layer to substantially maintain the selected moisture content in the upper surface layer, wherein the stabilizing and fluid conductivity providing means provides a stabilizing layer of adhesive material disposed atop the subsurface reservoir bed, the layer of adhesive material comprising voids therein to provide adequate fluid conductivity between the subsurface reservoir bed and the upper surface layer thereabove to substantially maintain the selected moisture content in the upper surface layer, the upper surface layer of fine aggregate material disposed atop and in the voids of the adhesive coated stabilizing layer.

23. The invention of claim 22 further comprising the step of providing a support bed of aggregate beneath the moisture barrier.

24. The invention of claim 23 wherein the moisture barrier providing step comprises providing an intermediate stabilizing layer atop the support bed of aggregate.

25. The invention of claim 24 wherein the intermediate stabilizing layer providing step comprises providing an adhesive material atop the support bed of aggregate.

26. The invention of claim 25 wherein the adhesive material of said intermediate stabilizing layer providing step comprises providing voids therein to provide supportive stability to the support bed of aggregate and adequate fluid conductivity between the subsurface bed of aggregate and the support bed of aggregate to maintain selected moisture content in the structure.

27. The invention of claim 25 wherein the adhesive material of said intermediate stabilizing layer providing step comprises providing a solid layer substantially free of voids.

28. The invention of claim 22 wherein the moisture barrier providing step comprises providing a plastic sheet.

29. The invention of claim 22 further comprising the steps of controllably introducing fluid to and draining fluid from the subsurface bed of aggregate and the upper surface layer to substantially maintain a selected moisture content in the upper surface layer.

30. The invention of claim 29 wherein the fluid for the fluid introducing step comprises providing surface watering.

31. The invention of claim 30 wherein the surface watering step is carried out by providing conduit means disposed between the upper surface layer and the subsurface bed of aggregate.

32. The invention of claim 30 wherein the surface watering step comprises surface flooding.

33. The invention of claim 32 wherein the drain step comprises using the same conduit means as the surface flooding step.

34. The invention of claim 22 wherein the subsurface reservoir bed providing step comprises providing coarse aggregate.

35. The invention of claim 22 wherein the subsurface reservoir bed providing step comprises providing a mortar material.

36. The invention of claim 35 wherein the mortar material providing step comprises providing a mixture of cement, sand and water.

37. The invention of claim 36 wherein the mortar material providing step comprises providing the proportion by volume of cement to sand of approximately one part cement to 10–20 parts sand.

38. The invention of claim 35 wherein the mortar material providing step further comprises providing coarse aggregate.

* * * * *